United States Patent [19]

Hammond

[11] 4,150,624

[45] Apr. 24, 1979

[54] BULLET IDENTIFICATION MEANS

[76] Inventor: Michael D. Hammond, 16 Dumbarton Oaks Pl., Elgin, Ill. 60120

[21] Appl. No.: 800,620

[22] Filed: May 26, 1977

[51] Int. Cl.[2] ..... F42B 11/00

[52] U.S. Cl. ..... 102/1 M; 102/38 R; 102/92.3; 102/92.6

[58] Field of Search ..... 102/1 M, 92.1, 92.2, 102/92.3, 92.4, 92.6, 92.7, 38 R

[56] References Cited

U.S. PATENT DOCUMENTS

| | | | |
|---|---|---|---|
| 1,141,783 | 6/1915 | Dobregeansky | 102/92.3 |
| 1,275,669 | 8/1918 | Forbes | 102/92.7 |
| 1,650,908 | 11/1927 | Ramsey | 102/38 R |
| 2,592,434 | 4/1952 | Krasnow | 102/92.7 |

*Primary Examiner*—Verlin R. Pendegrass
*Attorney, Agent, or Firm*—Paul W. Grauer

[57] ABSTRACT

A method for identification of bullets is provided whereby a coded insert is fitted within a cartridge to accompany a bullet in its trajectory and provide source information when recovered.

1 Claim, 6 Drawing Figures

BULLET IDENTIFICATION MEANS

BACKGROUND OF THE INVENTION

This invention relates generally to a method for identifying bullets which have been discharged from firearms and more particularly to a method for tracing purchasers of bullets from some indicia recovered with them.

Present day control measures generally provide detailed information on firearm owners through registration and serial numbers, but these controls omit records of the bullets purchased. Although a bullet may be traced to a firearm owner by recognized ballistic tests, such tests require that the tester have possession of the firearm and, also, that the recovered bullet be intact. The identity of the firearm owner may be difficult, if not impossible, to discover in most cases and, accordingly, the testing of his firearm for ballistic information would be difficult. Without adequate control and documentation of the sale of bullets, the effectiveness of firearm registration remains minimal.

Until now, means for control of the manufacture, sale, and possession of bullets and cartridges have not been available and this ammunition is generally sold without adequate records being kept on the purchaser or the items purchased. Advocates for the possession of firearms by the general public have recognized a need for strict controls over the manufacture, sale, and possession of ammunition as well as over firearms. However, such control measures, to be of practicle use to law enforcement personnel, must allow the accurate determination of identifying indicia from recovered bullets, and, therefore, the indicia must not only follow the projectile to its destination, but must remain intact for later analysis.

SUMMARY OF THE INVENTION

Accordingly, it is the primary aim of the present invention to provide an identification method to be used for the control of the manufacture, sale, and possession of bullets and cartridges for firearms.

It is a further object of the present invention to provide an identification for bullets which is difficult to alter or remove.

It is also an object of the present invention to provide identification means which remain intact throughout collision and the accompanying deformation of the projectile and thereby preserve the coded indicia for analysis.

It is further an object of the present invention to provide a bullet coding system which exhibits security features and deters tampering.

It is finally an object of the present invention to provide projectile identification means which is compatible with modern record keeping and documentation.

Other objects and advantages of the invention will become apparent upon reading the following detailed description and upon reference to the drawings.

While the invention will be described in connection with a preferred embodiment, it will be understood that I do not intend to limit the invention to that embodiment. On the contrary, I intend to cover all alternatives, modifications and equivalents as may be included within the spirit and scope of the invention as defined by the appended claims.

DESCRIPTION OF THE PREFERRED EMBODIMENT

Figure 1:
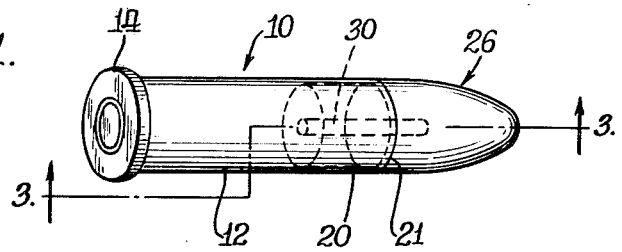
FIG. 1 is a perspective view of a cartridge showing a bullet employing an embodiment of the present invention.

Referring now to FIG. 1, there is shown a cartridge 10 for use in modern firearms. The cartridge is of the type which, upon the detonation of a propellant confined within the shell, will launch the projectile mounted at the shell's open end. More specifically, in FIG. 1 there is shown a shell 12 with a rear rim portion 14 and a foreward overlapping portion 20 terminating in an open end 21. Located within the shell, between the rim portion 14 and the overlapping portion 20, is a space 22 for the containment of a propellant. In a completed cartridge the rear portion 24 of bullet 26 provides a sealing fit with the overlapping shell portion to thereby confine the propellant.

Figure 3:
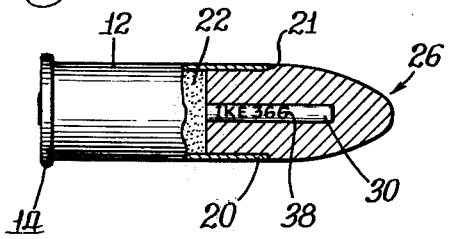
FIG. 3 is a cut-away perspective view of the bullet of FIG. 1 taken along line 3—3.

A preferred embodiment of the identification means of the present invention is best understood by reference to FIG. 3 in which the projectile 26 is drawn in a cutaway view. An elongated insert 30 is shown located within the projectile toward its rear portion and, as more fully discussed below, is held rigidly within the projectile and secured therein to deter tampering.

Figure 2:
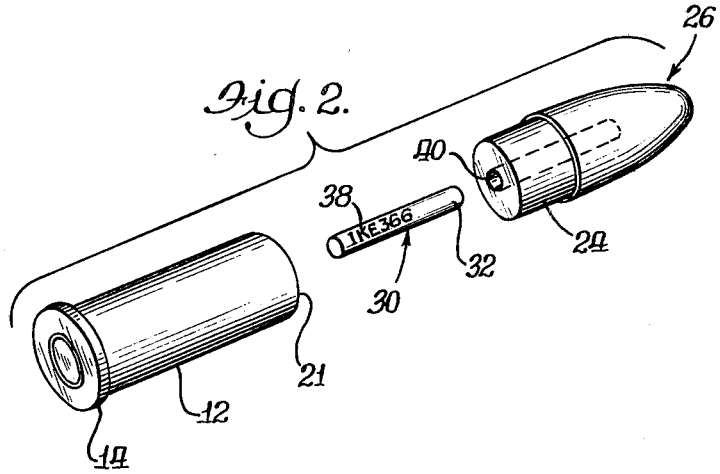
FIG. 2 is an expanded view of the cartridge of FIG. 1.

In FIGS. 1 through 3 the insert 30 represents a coded pin of uniform cross-section placed within the projectile 26 during manufacture or assembly of the cartridge. More particularly, the insert is preferrably much smaller in cross-section than the projectile to minimize any affect on the performance or trajectory of the bullet.

For holding the pin 30 in place there is provided a tight fit between the pin and the corresponding opening 40 in the projectile (FIG. 2). This is accomplished in the preferred embodiment by force fitting the pin into an undersized hole. The pin may be secured in place by the application of heat to the pin and the surrounding projectile material to provide some flow of the softer bullet material and to fill the opening 40 behind the inserted pin. The projectile is preferably made of low-melting point material. To this end heat may be applied to the local area by an external source after the insertion of the pin, or a heated pin itself may act as the heat source. In the preferred embodiment, the pin is inserted while in a heated but rigid state and, upon deep penetration, some flow of the soft bullet material behind the pin is achieved and the pin is secured in place by such displaced material upon cooling. After recovering the ejected projectile and its corresponding identification member, the identification member may be removed from the projectile utilizing the low-melting point material properties of the projectile and analyzed as to its source.

As an alternative to the above described insertion process, the pin 30 may be forced into a soft or molten bullet during its forming process. Inasmuch as bullets are commonly made of lead or lead alloy with a low melting point, the pin may be inserted easily and with a minimal risk of any alteration to its physical characteristics, providing that a sufficiently hard material is chosen for the pin. An iron or iron alloy pin is, accordingly, chosen for the preferred embodiment. Finally, as in the previously described process, this alternative also provides a flow of material local to the pin to close the insertion opening and secure the pin in place.

Reference now being made to FIG. 2, the pin 30 is shown in more detail. Particularly, there is provided a cylindrical solid object with an outer lateral surface 32. In the preferred embodiment the pin is marked with coded indicia of the form of raised or impressed characters 38 along the lateral surfaces and of a size detectable by unaided visual inspection. In more elaborate coding schemes, however, the code may be incorporated into a surface impregnating scheme whereby the chemical composition of the lateral surfaces would be varied in a prearranged code by the injection of a chemically or electrically detectable substance. Although more sophisticated laboratory detection techniques would be required with this alternative coding scheme, increased security could be obtained. Under either coding method, however, the pin yeilds original source identification information controlled by the manufacturer.

Figure 4:
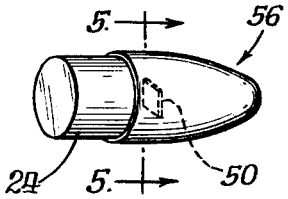
FIG. 4 is a perspective view of a bullet employing an alternative embodiment of the present invention.
Figure 5:
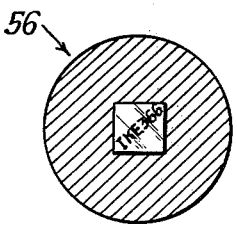
FIG. 5 is a sectional view of the bullet of FIG. 4 taken along line 5—5.
Figure 6:
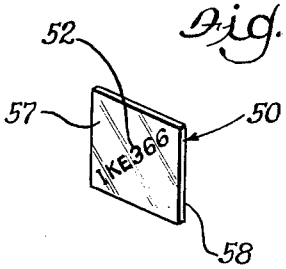
FIG. 6 is an enlarged view of the identification wafer of FIG. 5.

In a further form of the present invention (FIGS. 4,5,&6) a wafer 50 with coded indicia 52, is provided. This wafer, as in the previously described pin embodiment, is small in size and weight in comparison to the projectile 56. In FIG. 6 there is shown an enlarged view of the wafer embodiment. Particularly, there is provided a thin rectangular solid of preferrably minute size and having two faces 57 and 58. Coded identification information is provided on one or both of the faces. Under this alternative form, precoded wafers 50 are imbedded in the bullets during manufacture. Improved security is provided since the bullet would have to be substantially destroyed to alter or remove the identifying wafers. Finally, the insertion of the wafer, as in the pin embodiment, may be accomplished by impressing it into the inner portion of the bullet during the forming process.

By employment of popular micro-technology as is common in the production of modern transisters and integrated circuits, microscopic coding patterns may be reproduced on the insert whether of pin or wafer variety. Further, with the use of microscopic codes, the overall dimensions of the insert may be reduced proportionately and may even approach the miniature size of transisters or integrated circuits. Laboratory examination of the insert under powerful microscopes would reveal the coded indicia and provide the identifying and tracing information preserved thereon.

From the above description it is seen that means for the identification of bullets is provided which exhibit characteristics of security, preserves the coded indicia through collision and deformation, is compatible with modern manufacturing processes, and does not interfere with the performance of the cartridge or the projectiles.

I claim:

1. A method for identifying recovered bullets ejected from a cartridge comprising the steps of: inserting and securing a hardened identification member in the interior of the projectile made of low-melting point material to provide continuous engagement during ejection and flight; recovering the ejected projectile and its corresponding identification member; removing the hardened identification member from the projectile utilizing the low-melting point material properties; and analyzing the identification member so removed for information as to its source.

* * * * *